United States Patent [19]

Lee et al.

[11] 4,180,254

[45] Dec. 25, 1979

[54] SURGICAL APPARATUS

[75] Inventors: Alan J. C. Lee, Exeter; Robin S. M. Ling, Teignmouth, both of England

[73] Assignee: National Research Development Corporation, London, England

[21] Appl. No.: 893,603

[22] Filed: Apr. 3, 1978

[30] Foreign Application Priority Data

Apr. 1, 1977 [GB] United Kingdom ..... 13867/77

[51] Int. Cl.[2] ..... A61G 13/00

[52] U.S. Cl. ..... 269/328; 269/322

[58] Field of Search ..... 5/327 R; 269/322–328

[56] References Cited

U.S. PATENT DOCUMENTS

| | | | |
|---|---|---|---|
| 2,452,816 | 11/1948 | Wagner | 269/328 |
| 3,509,876 | 5/1970 | Pilz | 269/328 |
| 3,643,938 | 2/1972 | Levasseur | 269/328 |
| 3,823,709 | 7/1974 | McGuire | 269/328 |
| 3,844,550 | 10/1974 | McGuire | 269/328 |

*Primary Examiner*—Robert C. Watson

*Attorney, Agent, or Firm*—Cushman, Darby & Cushman

[57] ABSTRACT

Surgical apparatus for locating a patient lying on his side to facilitate hip surgery by the so-called Southern approach comprises a first platform part to support the patient's lower hip, two posts upstanding from respectively opposite sides of this part to engage the patient about the rear and front of his pelvis, a second platform part extending from the first part to support the patient's lower leg, at least one further post upstanding from the second part, and a third platform part connected to the further post above the second part to support the patient's upper leg. Preferably the first posts are adjustable in mutually opening and closing manner, such posts are respectively shorter and longer, all posts are adjustable in height, and the third platform part is adjustably tilted.

8 Claims, 1 Drawing Figure

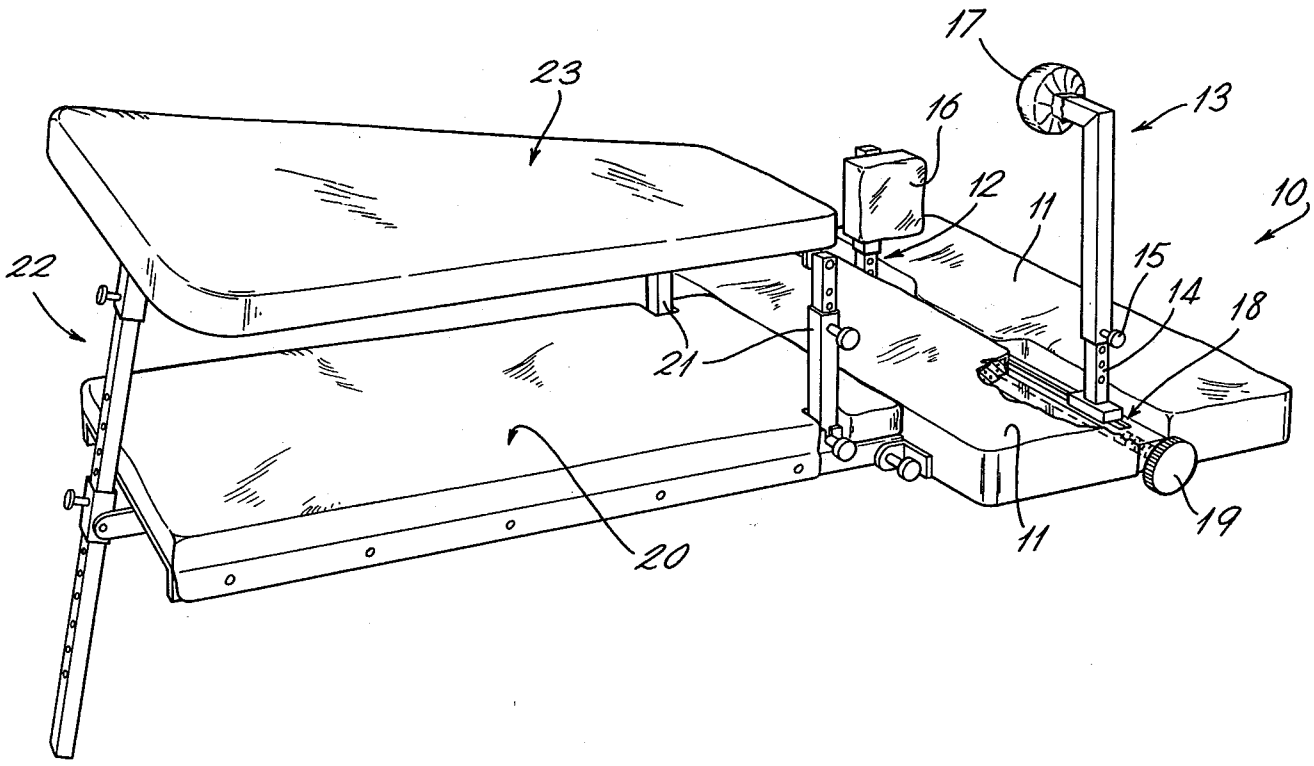
10
13
17
16
12
11
15
14
18
19
11
21
20
23
22

SURGICAL APPARATUS

This invention concerns surgical apparatus and more particularly such apparatus for supporting, at least partially, a patient during surgery.

The invention has been developed primarily for use during operations on the hip joint, typically for the provision of a prosthetic joint replacement, and especially for such operation by way of the so-called Southern approach. This approach is best effected by locating the patient on his side, with one leg above the other, but existing operating tables are not suited to maintaining such a location. In consequence it is normally necessary to employ a larger surgical team than may otherwise be necessary, with some of the team serving simply to maintain a desired patient location.

An object of the present invention is to alleviate this situation and there is accordingly provided surgical apparatus for locating a patient lying on his side comprising a first platform part to support the lower hip of the patient, two first posts upstanding from respectively opposite sides of said first platform part to engage the patient about the rear and front of his pelvis, a second platform part extending from the first such part to support the lower leg of the patient, at least one second post upstanding from said second platform part, and a third platform part connected to said second post in superposed disposition above said second platform part to support the upper leg of the patient.

Normally it will be appropriate for the first posts to be adjustable in mutually closing and opening manner to allow secure engagement of the pelvis with patients of varying size. Also it is preferred that one of the first posts be shorter to engage the lowermost buttock, and that the other of the first posts be higher to engage the uppermost frontal pelvic region of the patient. These engagement regions allow secure positioning of the pelvis without obstructing access to the upper hip joint from the rear and above. Preferably, the first posts are also adjustable in height to facilitate these engagements with patients of varying size.

It will also be appropriate normally for each second post to be adjustable in height to accommodate patients of varying size, and it is preferable that the third platform part be inclined or adjustably tiltable to allow support of the patients upper leg with the foot raised.

In order that the invention may be more clearly and fully understood, the same will now be described by way of example with reference to a presently preferred embodiment thereof as illustrated in a schematic perspective view by the accompanying drawing.

The illustrated embodiment comprises a first platform part 10 of rectangular, padded form, the padding being provided in two like areas 11 located in side-by-side disposition along the longitudinal dimension of the platform part. The areas 11 are slightly spaced towards their ends to allow upward vertical projection therebetween of two first posts 12 and 13. Each of these posts is of individually adjustable height by fabrication in two-part telescopic form with one part having a sequence of holes 14 therealong and the other a detent 15 for selective engagement therein.

One of the posts 12, is shorter than the other and it is provided at its upper end with a larger relatively flat pad 16. The other post 13 is longer, its free end portion is turned inwardly over the platfrom portion 10, and it has a smaller, rounded pad 17 at its free end.

The posts 12 and 13 are mounted at their lower ends on a screw mechanism 18 extending between the platform areas 11, this mechanism being operable by a handgrip 19 to adjust the spacing of the posts in mutually opening and closing manner. One of the areas 11 is laterally extended in the central portion of its inner longitudinal edge to bridge over the screw mechanism 18 and abut the other such area.

A second platform part 20 of rectangular padded form is connected at one end to extend from a longitudinal edge of the platform part 10 in a general T-shape. The platform part 20 has three second posts upstanding therefrom. Two of these posts, denoted 21, are connected to the platform part 20 in respectively opposite longitudinal edge portions thereof adjacent the platform part 10, and the third post, denoted 22, is connected to the remote end edge region of the part 20. The posts 21 are of like shorter form upstanding vertically from the part 20, while the post 22 is longer and is pivotally connected to the part for rotation about an axis parallel to the adjacent end edge of part 20. Each of the posts 21 and 22 is of two-part telescopic form similar to posts 12 and 13.

A third platform part 23 of padded, laterally-tapered elongate form is connected to the second posts 21 and 22 for superposition above the platform part 20, with the narrower end of the part 23 being nearer part 10. The platform part 23 is connected to posts 21 and 22 by pivotal connectors having axes parallel to that at the foot of post 22.

In use of the illustrated apparatus, a patient is located with one hip supported on the platform part 10, the respective leg extending along the platform part 20, and the other leg extending along the platform part 23, the part 23 being adjustable in both height and inclination by way of the posts 21 and 22 to accommodate this location for a given patient. The posts 12 and 13 are adjusted in height respectively to locate their pads 16 and 17 at the same levels as the lower buttock and diagonally opposed upper frontal pelvic region of the patient, and the screw mechanism is then operated to close these pads into engagement with the patient. Access to the patients upper hip is then available by the Southern approach, from above and behind, and is facilitated by the pelvic securement and the ability to manipulate the upper leg. However, while manipulation of the upper leg is necessary for the purposes of the hip joint dislocation as a preliminary to prosthetic replacement, securement of the leg is required for the purposes of the provision of a femoral head component in such replacement. Accordingly, some additional means may be provided for the purposes of this last securement.

The apparatus is suitably provided in a form such as that illustrated in which the various platform parts and posts are separable so that the apparatus can be assembled when required and employed as a supplement to an existing operating table. Indeed this form of apparatus is suited to use in emergency situations where conventional permanently-sited equipment is not available. It is, in any case, desirable that the second platform part be connectable to either side of the first platform part, or that at least the upper parts of the first posts be interchangeable, so that a patient can be supported as described for operation on either hip.

We claim:

1. Surgical apparatus for locating a patient lying on his side comprising a first platform part to support the lower hip of the patient, two first posts upstanding from respectively opposite sides of said first platform part to engage about the rear and front of his pelvis, a second platform part extending from the first such part to support the lower leg of the patient, at least one second post upstanding from said second platform part, and a third platform part connected to said second post in superposed disposition above said second platform part to support the upper leg of the patient.

2. Apparatus according to claim 1 wherein said first posts are adjustable in mutually closing and opening manner.

3. Apparatus according to claim 1 wherein one of said first posts is shorter to engage the lowermost buttock of the patient, and the other of said first posts is higher to engage the uppermost frontal pelvic region of the patient.

4. Apparatus according to claim 1, wherein said first posts are adjustable in height.

5. Apparatus according to claim 4 wherein each said second post is adjustable in height.

6. Apparatus according to claim 1 wherein said third platform part is inclined to support said upper leg with the foot raised.

7. Apparatus according to claim 1 wherein said third platform part is adjustably tiltable to support said upper leg with the foot raised.

8. Apparatus according to claim 5 wherein said first posts are adjustable in mutually opening and closing manner, one of said first posts is shorter to engage the lowermost buttock of the patient, the other of said first posts is higher to engage the uppermost frontal pelvic region of the patient, and said third platform part is adjustably tiltable to support said upper leg with the foot raised.

* * * * *